US007748832B2

(12) United States Patent
Page et al.

(10) Patent No.: US 7,748,832 B2
(45) Date of Patent: Jul. 6, 2010

(54) PRINTING APPARATUSES AND RELATED APPARATUSES AND METHODS

(75) Inventors: Scott G. Page, Alstead, NH (US); James M. Cheever, Lempster, NH (US); L. Edward Drew, II, Keene, NH (US); Jeffrey B. Brooks, Sullivan, NH (US)

(73) Assignee: Markem-Imaje Corporation, Keene, NH (US)

( * ) Notice: Subject to any disclaimer, the term of this patent is extended or adjusted under 35 U.S.C. 154(b) by 831 days.

(21) Appl. No.: 11/647,835

(22) Filed: Dec. 29, 2006

(65) Prior Publication Data

US 2008/0158308 A1 Jul. 3, 2008

(51) Int. Cl.
*B41J 2/175* (2006.01)

(52) U.S. Cl. ..... 347/85

(58) Field of Classification Search ..... 347/84, 347/85; 141/2, 18; 62/50.7; 165/142; 138/137, 138/177

See application file for complete search history.

(56) References Cited

U.S. PATENT DOCUMENTS

| | | | | | |
|---|---|---|---|---|---|
| 3,777,502 | A * | 12/1973 | Michie et al. | ..... | 62/50.7 |
| 3,840,035 | A * | 10/1974 | Lefever | ..... | 137/13 |
| 3,861,461 | A * | 1/1975 | Kissinger | ..... | 165/142 |
| 5,641,346 | A | 6/1997 | Mantell et al. | | |
| 5,956,057 | A * | 9/1999 | Childers et al. | ..... | 347/49 |
| 5,988,801 | A * | 11/1999 | Coiner | ..... | 347/85 |
| 6,183,078 | B1 | 2/2001 | Petrzyk et al. | | |
| 6,250,746 | B1 * | 6/2001 | Ito et al. | ..... | 347/86 |
| 7,325,909 | B2 * | 2/2008 | Yuen | ..... | 347/85 |

* cited by examiner

*Primary Examiner*—Anh T. N. Vo
(74) *Attorney, Agent, or Firm*—Fish & Richardson P.C.

(57) ABSTRACT

Apparatuses and methods that utilize material-handling systems in which material in the systems has enhanced stability, e.g., during conveyance of the material from a reservoir to a printhead through a conduit, the conduit having a conduit wall defining an inner conduit space and including a material line for carrying the printing material in the inner conduit space, wherein the inner conduit space is configured to carry a heated liquid, being heated from a liquid heater, to contact the material line.

27 Claims, 8 Drawing Sheets

PRINTING APPARATUSES AND RELATED APPARATUSES AND METHODS

TECHNICAL FIELD

This invention relates to printing apparatuses, material-handling apparatuses, and to related apparatuses and methods.

BACKGROUND

Some radiation-curable, e.g., UV-curable, jetting inks are liquid at room temperature. To ensure correct jetting viscosity, these liquid radiation-curable inks are often jetted above room temperature, e.g., 30° C. or more, e.g., 40° C. Such inks can be jetted onto substantially non-porous substrates, e.g., plastic pen barrels or circuit boards, or porous substrates. When such liquid radiation-curable inks are jetted onto a substrate, e.g., paper or plastic, to form an image, phenomena such as bleed-through, pinhole wetting and fisheyes due to the wetting characteristics of the liquid can result in inadequate ink coverage and overall poor print quality. One solution that is often used to reduce wicking is to treat the substrate to make it less porous. However, some inks do not perform well with such treatments. Another solution to minimizing wicking and bleed-through is to rapidly surface cure the ink, but often this does not completely eliminate wicking and bleed-through, and can require cumbersome and expensive equipment.

"Hybrid-F" radiation-curable jetting inks, i.e., those that polymerize by radical and/or cationic mechanisms to give polymer networks, are often described as "semi-solid inks," and are more viscous at room temperature than at jetting temperature. Hybrid-F inks are available from Aellora™, e.g., under the tradename VistaSpec™ HB. Typically, these inks are jetted at elevated temperatures, e.g., above 60° C. or above 65° C., to lower ink viscosity to an appropriate jetting viscosity. After jetting hybrid-F ink, e.g., through a piezoelectric drop-on-demand inkjet printhead, ink viscosity rapidly increases as the ink cools on contact with the substrate. Once cooled to about room temperature, the hybrid-F ink does not flow without shear, allowing "wet-on-wet" printing without intermediate curing stages. Since the hybrid-F ink does not substantially flow at room temperature, wetting defects can be reduced, often reducing or eliminating the need for substrate surface treatments.

SUMMARY

This invention relates to printing apparatuses, material-handling apparatuses, and to related apparatuses, devices and methods.

Generally, apparatuses and methods are described that utilize material-handling systems that maximize the stability of the material, e.g., an ink or a clear overcoat material. For example, the ink-handling systems can reduce premature polymerization, resulting in systems having a reduced tendency to clog and foul.

In one aspect, the invention features printing apparatuses that include a material delivery module that includes a reservoir for storing a printing material, a docking station and a conduit connecting the reservoir and the docking station. The conduit has a conduit wall that defines an inner conduit space and includes a material line in the inner conduit space for carrying the printing material from the reservoir to the docking station. Optionally, a print engine is connected to the docking station for ejecting drops of the printing material.

In some embodiments, the material delivery module further includes a liquid heater in communication with the inner conduit space. Advantageously, in some instances, the liquid heater includes a liquid replenishing port for replenishing spent and/or evaporated liquid.

In some uses, the conduit includes a liquid flowing in the inner conduit space at a temperature above about 25° C.

In some embodiments, the conduit includes a liquid flowing in the inner conduit space, the flowing liquid and/or any material being carried in the material line being held at a temperature that does not substantially vary with time. For example, in some instances, the temperature of the flowing liquid and/or any material being carried in the material line does not vary with time more than about 3.5° C. above a set point, e.g., not more than 2.0° C. above the set point, and/or not more than about 6.0° C. below the set point, e.g., not more than 5.0° C. below the set point, after thermal equilibrium is established. The ability to maintain tight temperature control can, e.g., reduce thermal polymerization of materials being conveyed through the disclosed systems. Tight temperature control can also provide for a constant viscosity of the materials flowing through the systems.

In some instances, the conduit also includes a liquid flowing in the inner conduit space, the flowing liquid entering the inner conduit space from the heater through an entry port, and then exiting the inner conduit space through an exit port in fluid communication with the heater. Such a configuration can allow for replenishing heat lost from the liquid during heat transfer.

In some instances, the liquid has a relatively high a specific heat capacity to help maintain temperature control. For example, in some embodiments, the liquid has a specific heat capacity at 25° C. ($C_{p25° C.}$) of greater than about 2.0 J/gK, e.g., greater than about 3.25 J/gK.

To reduce the likelihood of pressure built-up in the system at higher temperatures, in some instances, a relatively high boiling point liquid is utilized. For example, the liquid can have a boiling point of greater than about 65° C., greater than 80° C., or even greater than 105° C. In some embodiments, the liquid can be a mixture of materials, such as a mixture of water and ethylene glycol.

In some implementations, the docking station is in electrical communication with the print engine. The docking station can, e.g., include a valve operable on command from the print engine for controlling flow of the printing material.

In some embodiments, the reservoir is connected to the conduit by an interface that includes a liquid flow pathway for delivering liquid to the inner conduit space of the conduit. In some instances, the conduit is connected to the docking station by an interface that includes a liquid return pathway for transferring liquid exiting the conduit into a liquid return line in the inner conduit space.

The material in the reservoir can be heated to a temperature above about room temperature, e.g., 25° C. In some instances, the reservoir includes a pump for conveying the printing material through the material line in the conduit. In some implementations, the reservoir includes a mixing device, e.g., an ultrasonic mixer or a mechanical mixer, for homogenizing the printing material.

The inner conduit space can have more than a single material line, e.g., 2, 3, 4, 5, 6, 7, 8 or more lines, e.g., 12 lines.

In specific embodiments, the reservoir includes six different material colors, and the inner conduit space has a material line for each of the six different colors.

In some embodiments, the material delivery module includes a radiation curable ink housed in a component thereof.

The conduit can, e.g., have a longitudinal length of between about 1 meter and about 40 meters, e.g., 1 meter and about 20 meters or between about 3 meters and 10 meters.

In another aspect, the invention features apparatuses for handling a printing material that include a conduit having a conduit wall defining an inner conduit space and including a material line for carrying the printing material in the inner conduit space. The inner conduit space is configured to carry a heated liquid to contact the material line. Contact between the heated liquid and the material line can, e.g., increase heat transfer, helping to maintain a relatively constant temperature of any material in the material line.

In some embodiments, the conduit also includes a liquid flowing in the inner conduit space, the flowing liquid and/or any material being carried in the material line being held at a temperature that does not substantially vary with time. For example, in some instances, the temperature of the flowing liquid and/or any material being carried in the material line does not vary with time more than about 3.5° C. above a set point, e.g., not more than 2.0° C. above the set point and/or not more than about 6.0° C. below the set point, e.g., not more than 5.0° C. below the set point, after thermal equilibrium is established. The ability to maintain tight temperature control can, e.g., reduce thermal polymerization of materials and/or provide for a constant viscosity of the materials flowing through the systems.

In some instances, the conduit also includes a liquid flowing in the inner conduit space, the flowing liquid entering the inner conduit space from the heater through an entry port, and then exiting the inner conduit space through an exit port in fluid communication with the heater.

In some instances, the liquid has a relatively high a specific heat capacity to help maintain temperature control. For example, in some embodiments, the liquid has a specific heat capacity at 25° C. ($C_{p25° C.}$) of greater than about 2.0 J/gK, e.g., greater than about 3.25 J/gK.

To reduce the likelihood of pressure built up in the system at higher temperatures, in some instances, a relatively high boiling point liquid is utilized.

In some embodiments, the liquid can be a mixture of materials, such as a mixture of water and ethylene glycol.

In another aspect, the invention features methods of handling a printing material that include providing a printing material; and conveying the printing material through an apparatus that includes a conduit having a conduit wall defining an inner conduit space and including a material line containing the printing material. The inner conduit space is configured to carry a heated liquid to contact the material line.

In another aspect, the invention features methods of printing on a substrate that include providing a printing material; conveying the printing material through an apparatus that includes a conduit having a conduit wall defining an inner conduit space and including a material line in the inner conduit space carrying the printing material and a pressure chamber communicating with the material line and an aperture; and pressurizing the pressure chamber to eject drops of the printing material out of the aperture.

In some embodiments, the pressure chamber forms part of a piezoelectric printhead.

The printing material can, e.g., be an ink, such as a radiation curable material.

Aspects and/or embodiments may have one or more of the following advantages. Generally, materials such as inks, clear overcoats, flavors and/or fragrances, in the material-handling systems described herein have enhanced stability, e.g., a reduced tendency to polymerize and/or a stable viscosity. For example, the ink handling systems have a reduced tendency to thermally polymerize ink flowing through the ink flow pathways, which can result in a system having enhanced ink flow and jetting performance. Such ink handling systems have a reduced tendency for ink flow pathway blockage, nozzle clogging, and/or valve blockage. This in turn reduces cleaning downtime and improves printing efficiency. Keeping the often small and delicate flow paths and/or nozzles clear of environmental containments and/or polymerized materials allows the ink to flow through the flow paths with reduced resistance. Lower resistance to flow enables, e.g., a more rapid refilling of the pumping chamber. For example, rapidly refilling the pumping chamber can translate into an ability to eject drops at a higher frequency, e.g., 10 kHz, 25 kHz, 50 kHz or higher, e.g., 75 kHz. Higher frequency printing can improve the resolution of ejected drops by increasing the rate of drop ejection, reducing size of the ejected drops, and enhancing velocity uniformity of the ejected drops. In addition, keeping nozzles and/or flow paths clear of polymerized ink can reduce ejection errors, such as mis-fires or trajectory errors, and thereby improve overall print quality. Also, the material handling systems allow material reservoirs which are on-board print engines to be re-filled "on the fly" without shutting down the print engine and/or stopping printing.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety for all that they contain. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION

Figure 1:
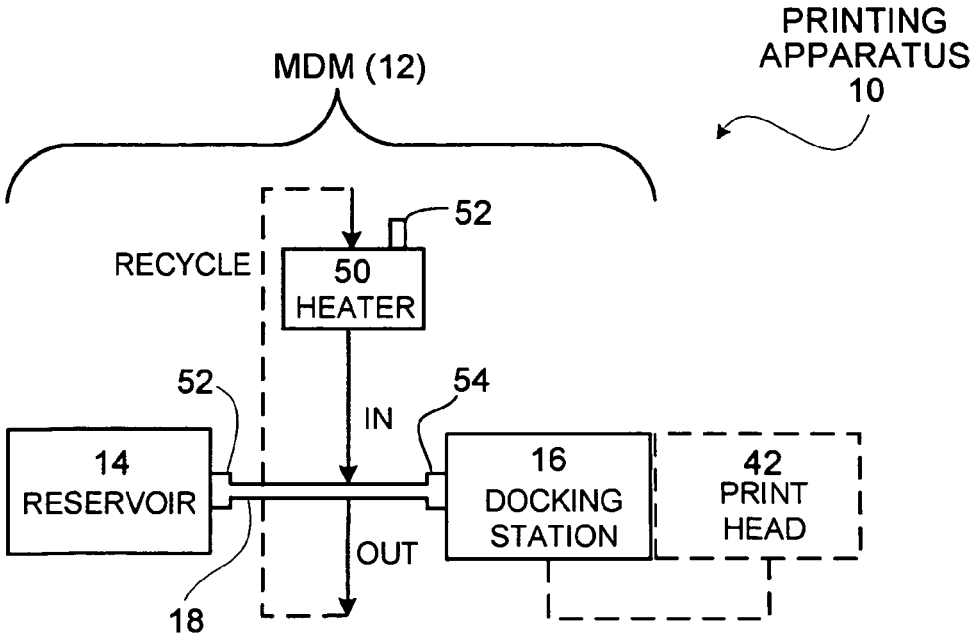
FIG. 1 is a block diagram of a printing apparatus that includes a material delivery module and a print engine.

Generally, apparatuses and methods are described that utilize material-handling systems in which the material, e.g., an ink or a clear overcoat material, in the systems has a reduced tendency to thermally polymerize during conveyance. Described systems can, e.g., reduce ink flow pathway blockages and nozzle clogging.

Referring to FIGS. 1, 2A, 2B, 2C, 3 and 3A, a printing apparatus 10 includes a material delivery module 12 that includes a reservoir 14 for storing a printing material, a docking station 16 and a conduit 18 connecting the reservoir 14 and the docking station 16. The conduit 18 has a conduit wall 26 that defines an inner conduit space 28. Housed within the conduit 18 and surrounded by the inner conduit wall 26 are six material lines 30, 32, 34, 36, 38, and 40 in the inner conduit space 28 for carrying the printing material from the reservoir 14 to the docking station 16. As shown, the conduit 18 is connected to the reservoir by a reservoir-conduit interface 52, and is connected to the docking station 16 by a conduit-docking station interface 54. In one implementation, material lines 30, 32, 34, 36, 38, and 40 each carry a different color of ink, e.g., black, light cyan, cyan, magenta, light yellow and yellow. In such a configuration, any other color desired can be obtained by mixing the six colors in the appropriate proportions at the print engine during printing. In use, print engine 42 can be rapidly connected to the docking station 16. In the implementation shown, the material delivery module 12 includes a liquid heater 50 that includes a liquid therein in communication with the inner conduit space 28. Optionally, the liquid heater 50 includes a liquid replenishing port 52 for replenishing spent and/or evaporated liquid. In use, a liquid, such as water or a mixture of water and ethylene glycol, is heated, e.g., above 25° C., in the liquid heater 50 and circulated in and out of the inner conduit space 28 of the conduit 18. The heated liquid fills the inner conduit space 28 and bathes the material lines 30, 32, 34, 36, 38 and 40 to heat and maintain the material in the lines at a substantially constant temperature, the material of the lines being protected from direct contact with the heated liquid by each respective material line wall. Such a configuration can provide for enhanced stability of the material in the material lines. For example, the relatively constant temperatures that can be maintained by such a configuration can reduce the likelihood of local "hot spots" in the system, which, in turn, can provide for a reduced tendency of the materials to polymerize during conveyance, and can also provide for a stable viscosity. As a final result, such a system can generally enhance jetting performance. Such an arrangement is also advantageous since it allows for materials to be changed out "on the fly" without interrupting printing. It also allows the ink to be brought to a desired print engine at a desired location.

Figure 2A:
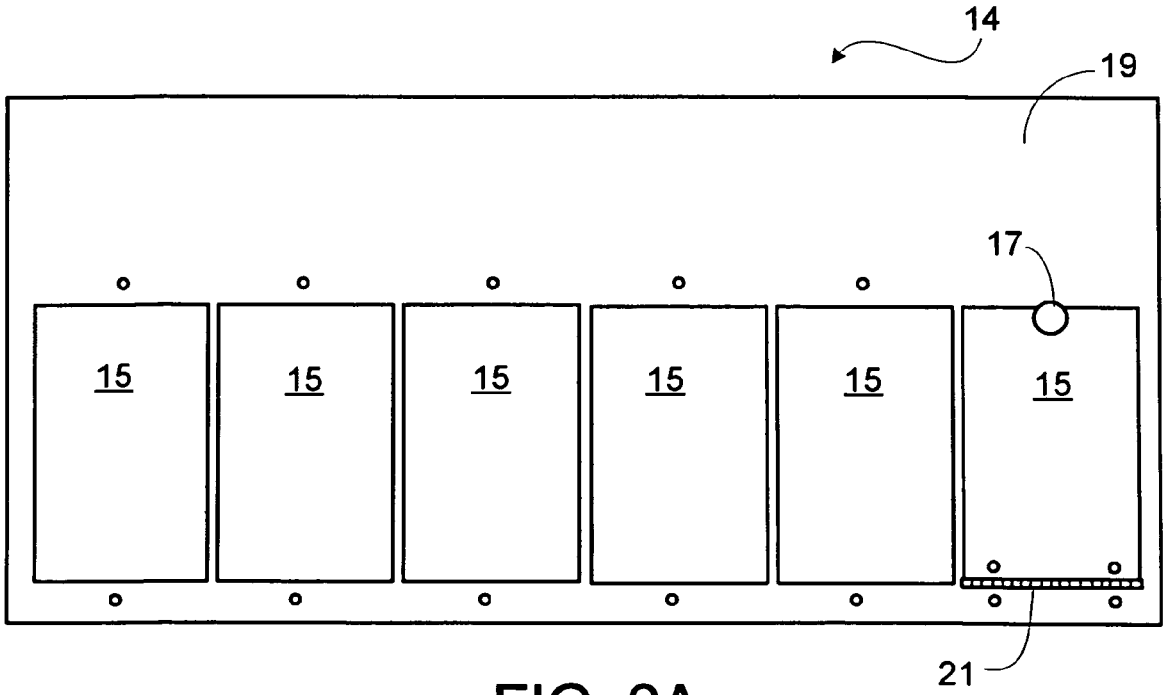
FIG. 2A is a front view of the reservoir shown in FIG. 1.
Figure 2B:
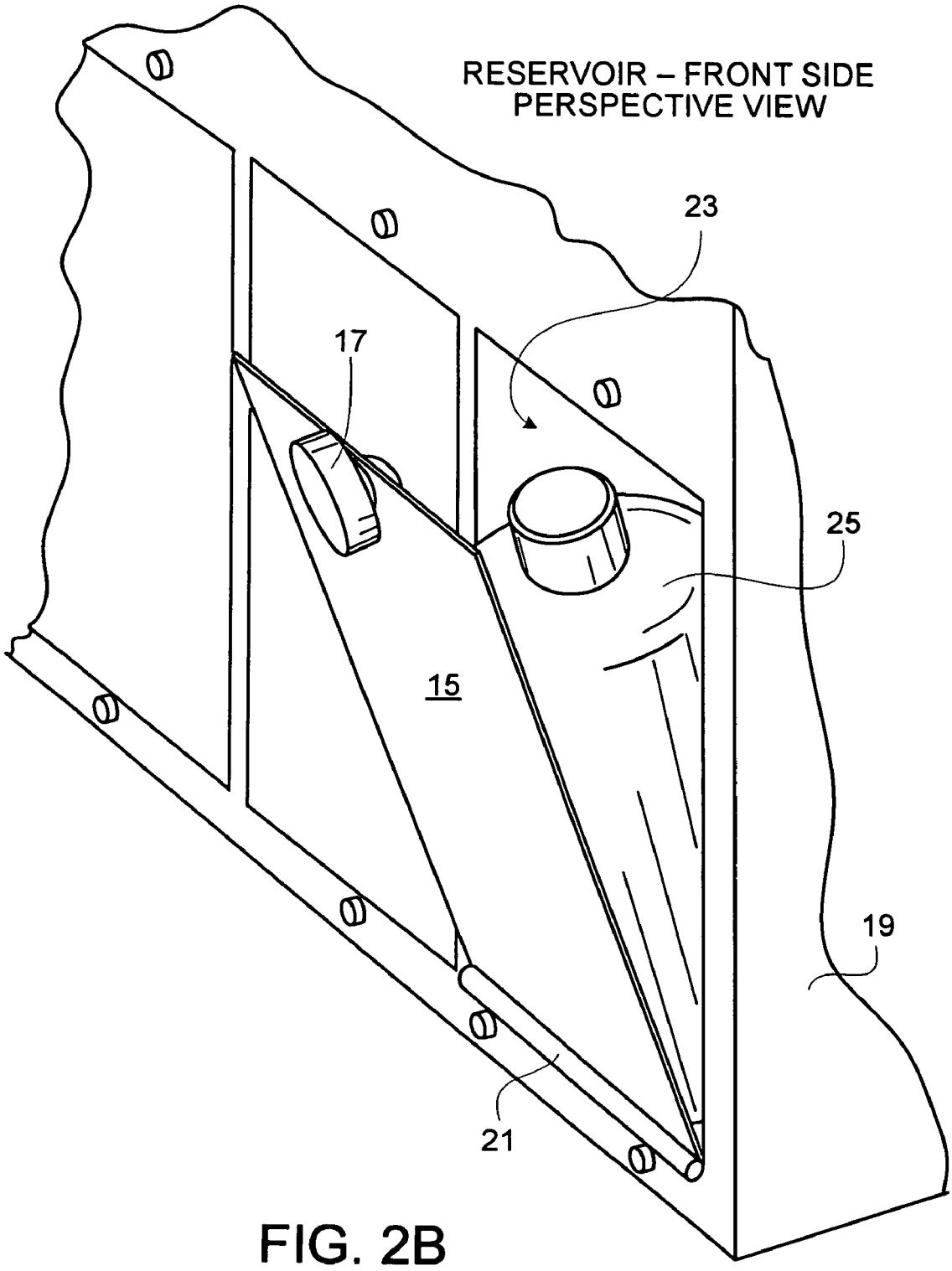
FIG. 2B is a perspective view of a portion of the reservoir of FIGS. 1 and 2A, illustrating a bottle of ink being placed into a compartment in the reservoir.
Figure 2C:
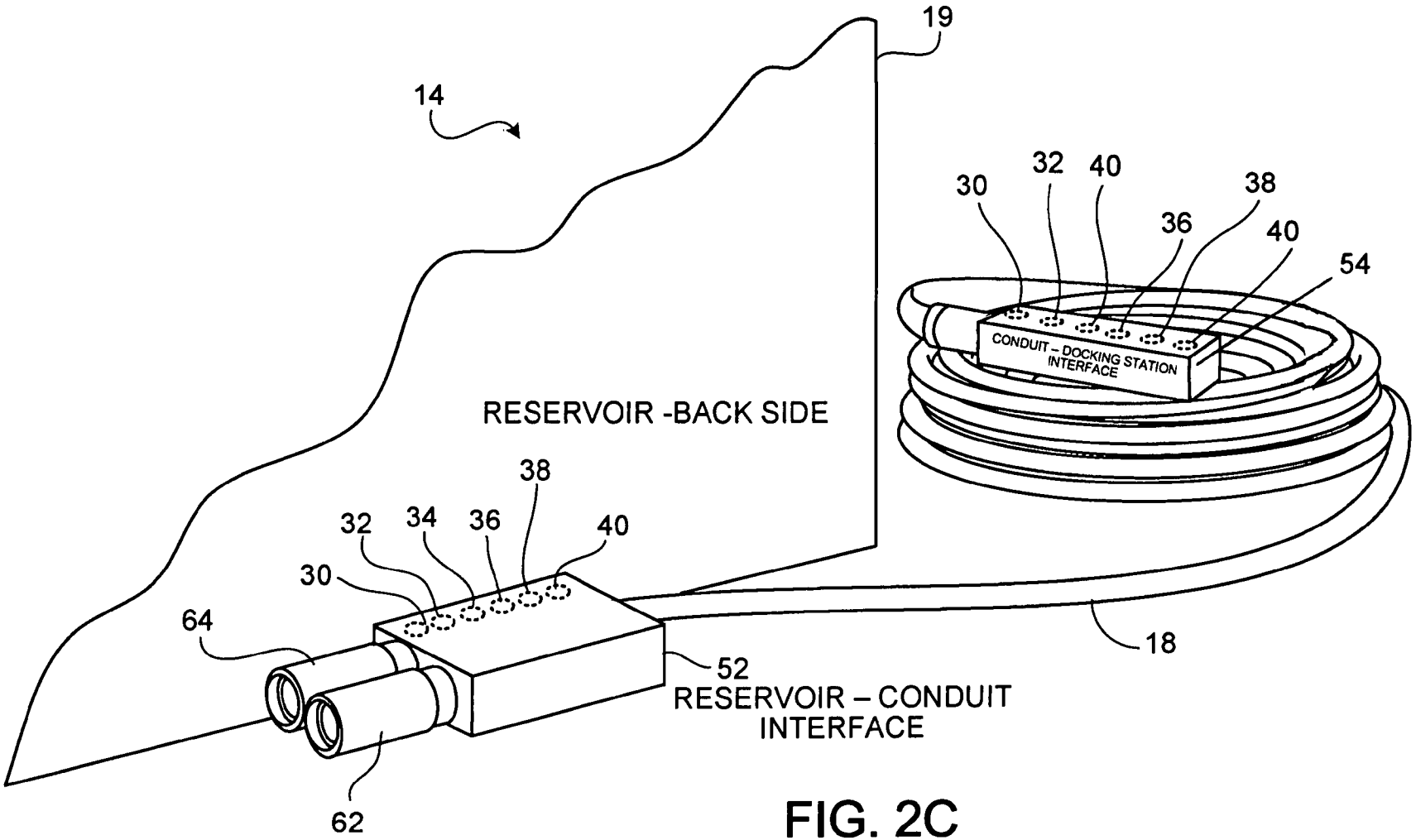
FIG. 2C is a perspective view of a portion of the reservoir of FIGS. 1, 2A and 2B with a conduit attached.

Referring particularly now to FIGS. 2A, 2B, 2C and 3 for a little more detail on upstream components. In the implementation shown, reservoir 14 includes six doors 15, each of which is attached to the reservoir housing 19 by a hinge 21. Each door conceals a corresponding compartment 23 accessed by pulling knob 17. Each compartment contains a bottle of ink 25, e.g., a 250 mL or 500 mL bottle of ink, of a particular color. Each bottle of ink being in fluid communication with its respective material line 30, 32, 34, 36, 38 or 40 in conduit 18. Referring particularly now to FIG. 2C, each bottle is connected to a material line 30', 32', 34', 36', 38' and 40' (not shown), which terminates on the back side of housing 19. Material line 30', 32', 34', 36', 38' and 40' are each respectively connected to material lines 30, 32, 34, 36, 38 and 40, which terminate on the near side in the reservoir-conduit interface 52. Material lines 30, 32, 34, 36, 38 and 40 extend through the conduit 18 and terminate on the far side at the conduit-docking station interface 54. Heated liquid from heater 50 enters the reservoir-conduit interface 52 via a line (not shown) connected to inlet port 62, travels through the conduit 18 in space 28, and is returned to the heater 50 by a line (not shown) connected to outlet port 64, as will be described in more detail below.

In some embodiments, the reservoir includes a pump, e.g., a pneumatic or peristaltic pump, for conveying each respective material through each respective material line in the conduit. If desired, the reservoir can include a mixing device, e.g., an ultrasonic mixing device, for homogenizing each printing material. In addition, each material in the reservoir can be heated, e.g., with hot air or with a heated liquid, to bring each material up to jetting temperature or close to jetting temperature prior to entering conduit.

Figure 3:
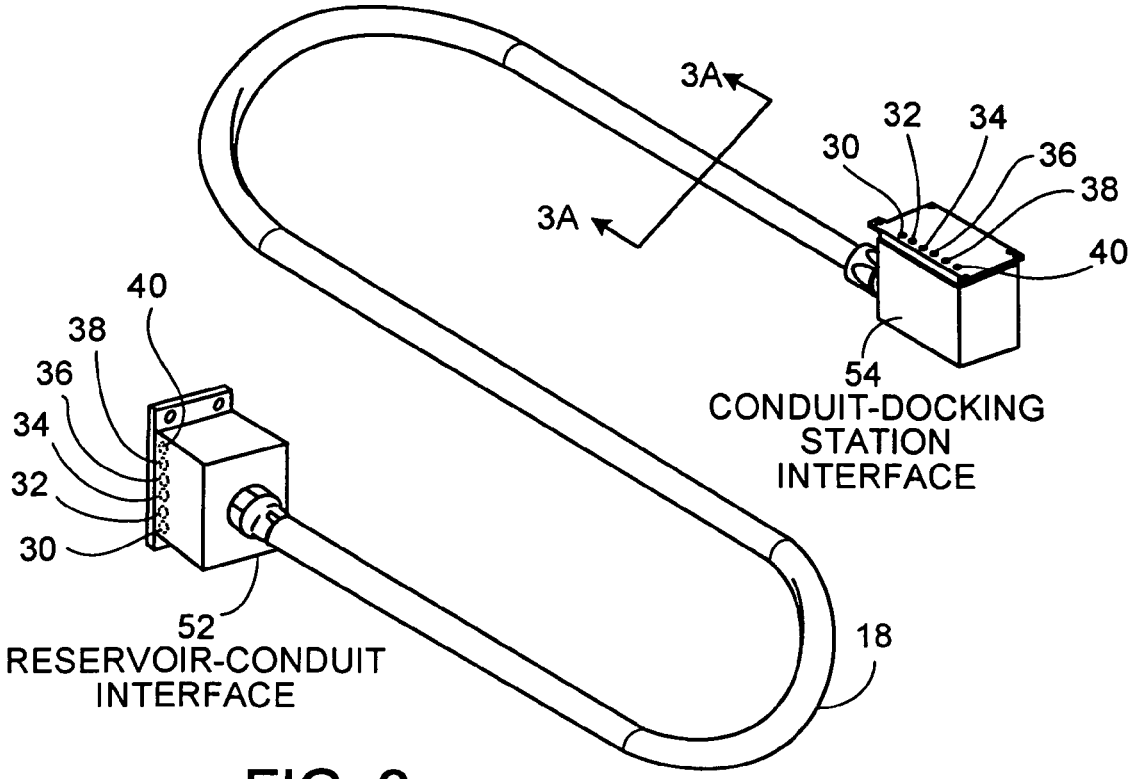
FIG. 3 is a perspective view of a conduit connected to interfaces.
Figure 3A:
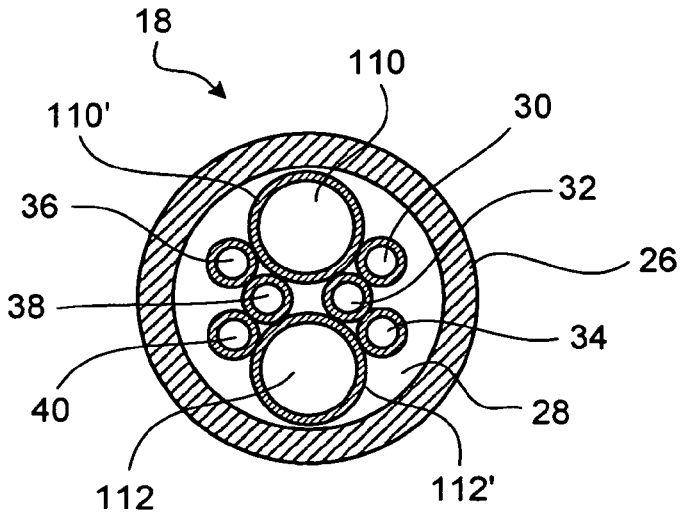
FIG. 3A is a cross-sectional view of the conduit, taken along 3A-3A.
Figure 3B:
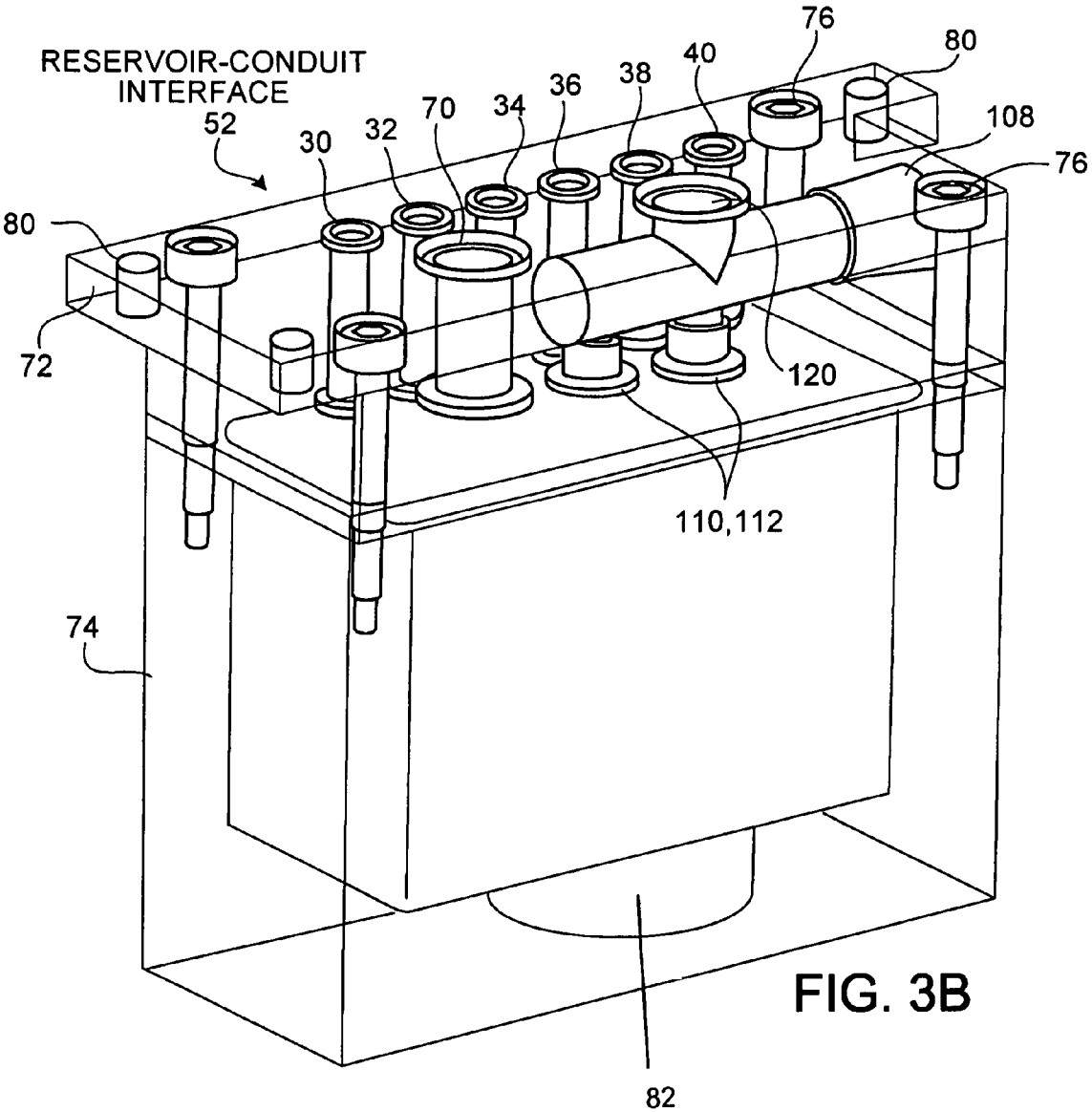
FIG. 3B is a perspective, partial see-through view of the reservoir-conduit interface.
Figure 3C:
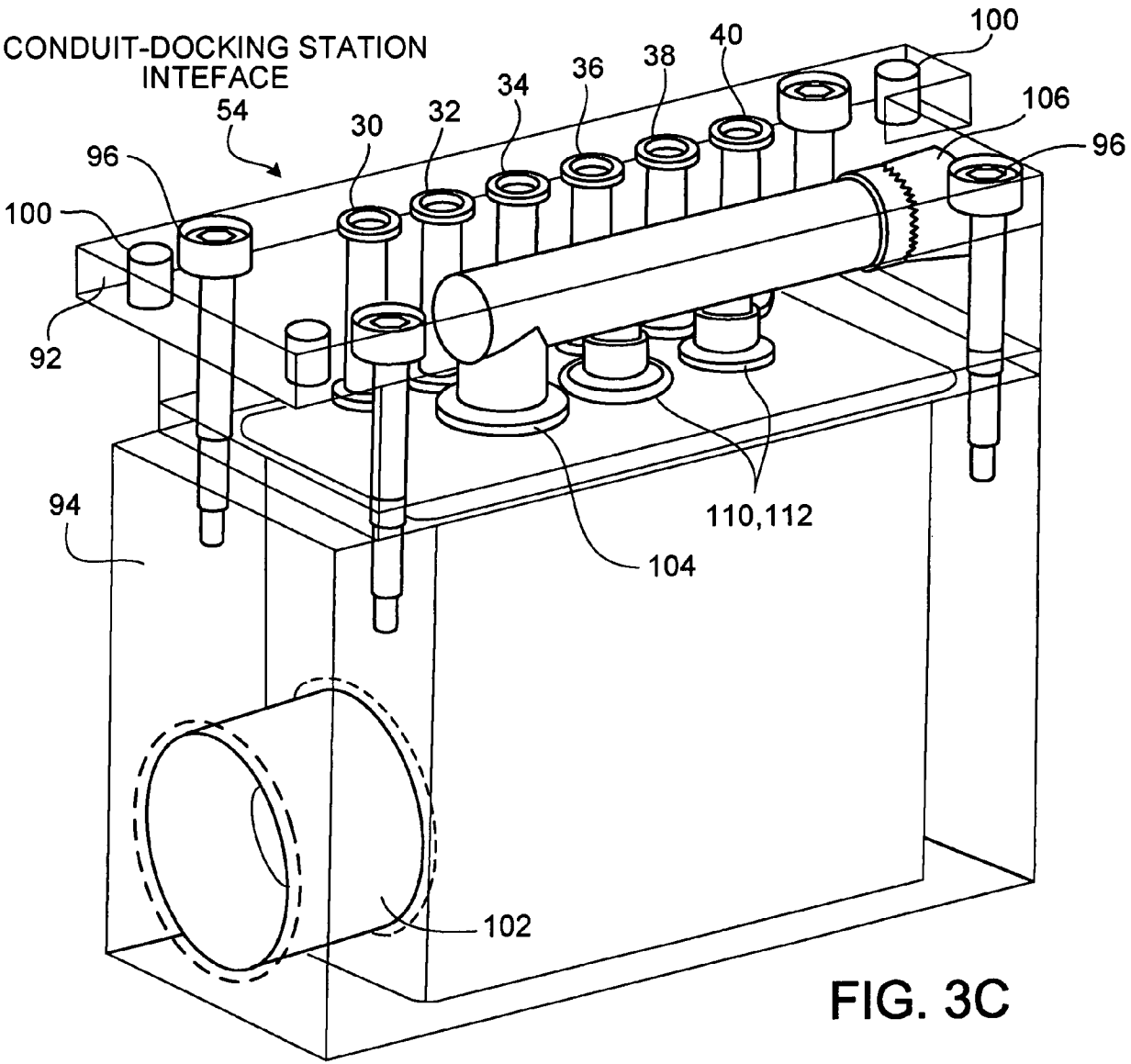
FIG. 3C is a perspective, partial see-through view of the conduit-docking station interface.

Referring now particularly to FIGS. 2C and 3B, the reservoir-conduit interface 52 includes a first portion 72 connected to a bottom portion 74 by bolts 76. The reservoir-conduit interface 52 connects to reservoir housing 19 by placing bolts through bolt holes 80 defined in top portion 72. This allows for registration of material lines 30', 32', 34', 36', 38' and 40' of the reservoir 14 with each respective material line 30, 32, 34, 36, 38 and 40. Referring now particularly to FIGS. 2C and 3C, the conduit-docking station interface 54 includes a first portion 92 connected to a bottom portion 94 by bolts 96. The conduit-docking station interface 54 connects to the docking station housing by placing bolts through bolt holes 100 defined in top portion 92. This allows for registration of material lines 30, 32, 34, 36, 38 and 40 with respective material lines 30", 32", 34", 36", 38" and 40" of the docking station (not shown). Referring also now to FIGS. 3 and 3A, heated liquid from heater 50 enters port 62 (FIG. 2C) and travels into line 70 and through coupling 82, which leads to open space 28 of conduit 18. The liquid travels the longitudinal length of conduit 18 and into coupling 102 in the conduit-docking station interface 54. Once in the conduit-docking station interface 54, the liquid enters deflector line 104, which returns the liquid back to the conduit through return lines 110, 112, the liquid in the lines being isolated from the incoming liquid by respective walls 110' and 112'. Return lines 110, 112 terminate in the reservoir-conduit interface 52, where they are brought together into a single return line 120 connected to port 64 for returning the liquid back to liquid heater 50. Flow rate in the return lines can be adjusted with a flow adjustment 106 or 108 in the conduit-docking station interface 54 or the reservoir-conduit interface 52, respectively.

In some embodiments, the liquid flowing in the inner conduit space and/or the materials being carried in the material lines are held at a temperature that does not vary with time by more than about 3.5° C. above a set point and/or not more than about 6.0° C. below the set point after thermal equilibrium is established. In some instances control can be even tighter, e.g., the liquid flowing in the open space and/or the materials in the material lines are held at a temperature that does not vary with time by more than about 2.0° C. above a set point and/or not more than about 5.0° C. below the set point after thermal equilibrium is established.

In some embodiments, the temperature of the liquid as it first enters the open space 28 of conduit 18 is not more that 2.5° C. higher, e.g., not more than 1° C. higher, than the temperature of the liquid as it returns from the conduit to the heater. This can be achieved by controlling flow rate of the heated liquid and or insulating conduit 18.

In order to maintain tight temperature control, it is often desirable that the liquid delivered from the liquid heater and flowing through the open space 28 have a specific heat capacity at 25° C. ($C_{p25° C.}$) of greater than about 2.0 J/gK, e.g., greater than 2.5, 3.0 or even greater than about 3.25 J/gK.

In some instances, e.g., in order to reduce pressure build-up in the lines used to deliver the heated liquid to the space 28, the liquid can advantageously have a boiling point of greater than about 65° C., e.g., greater than 70, 75, 80, 85, 90, 95 or even greater than 100° C.

The conduit can have nearly any desired longitudinal length. For example, it can be between about 1 meter and about 30 meters long, e.g., between about 1 meter and about 20 meters long, or between about 1 meter and about 10 meters long.

In some embodiments, liquid delivered to the open space 28 is a mixture of materials, such as water and ethylene glycol. Ethylene glycol is not only a high boiling material, but it is also biocidal, which can prevent slime build up in flow lines. If desired an additional biocide, such as a quaternary ammonium salt, can be added to reduce the formation of slime.

Generally, suitable inks include colorants, polymerizable materials, e.g., monomers and/or oligomers, and photoinitiating systems. The polymerizable materials can be cross-linkable.

Colorants include pigments, dyes, or combinations thereof. In some implementations, inks include less than about 10 percent by weight colorant, e.g., less than 7.5 percent, less than 5 percent, less than 2.5 percent or less than 0.1 percent.

The pigment can be black, cyan, magenta, yellow, red, blue, green, brown, or a mixture these colors. Examples of suitable pigments include carbon black, graphite and titanium dioxide. Additional examples are disclosed in, e.g., U.S. Pat. No. 5,389,133.

Alternatively or in addition to the pigment, the inks can contain a dye. Suitable dyes include, e.g., Orasol Pink 5BLG, Black RLI, Blue 2GLN, Red G, Yellow 2GLN, Blue GN, Blue BLN, Black CN, and Brown CR, each being available from Ciba-Geigy. Additional suitable dyes include Morfast Blue 100, Red 101, Red 104, Yellow 102, Black 101, and Black 108, each being available from Morton Chemical Company. Other examples include, e.g., those disclosed in U.S. Pat. No. 5,389,133.

Mixtures of colorants may be employed.

Generally, the inks contain a polymerizable material, e.g., one or more polymerizable monomers. The polymerizable monomers can be mono-functional, di-functional, tri-functional or higher functional, e.g., penta-functional. The mono-, di- and tri-functional monomers have, respectively, one, two, or three functional groups, e.g., unsaturated carbon-carbon groups, which are polymerizable by irradiating in the presence of photoinitiators. In some implementations, the inks include at least about 40 percent, e.g., at least about 50 percent, at least about 60 percent, or at least about 80 percent by weight polymerizable material. Mixtures of polymerizable materials can be utilized, e.g., a mixture containing mono-functional and tri-functional monomers. The polymerizable material can optionally include diluents.

Examples of mono-functional monomers include long chain aliphatic acrylates or methacrylates, e.g., lauryl acrylate or stearyl acrylate, and acrylates of alkoxylated alcohols, e.g., 2-(2-ethoxyethoxy)-ethyl acrylate.

The di-functional material can be, e.g., a diacrylate of a glycol or a polyglycol. Examples of the diacrylates include the diarylates of diethylene glycol, hexanediol, dipropylene glycol, tripropylene glycol, cyclohexane dimethanol (Sartomer CD406), and polyethylene glycols.

Examples of tri- or higher functional materials include tris(2-hydroxyethyl)-isocyanurate triacrylate (Sartomer SR386), dipentaerythritol pentaacrylate (Sartomer SR399), and alkoxylated acrylates, e.g., ethoxylated trimethylolpropane triacrylates (Sartomer SR454), propoxylated glyceryl triacrylate, and propoxylated pentaerythritol tetraacrylate.

The inks may also contain one or more oligomers or polymers, e.g., multi-functional oligomers or polymers.

In some instances, the viscosity of the ink is between about 1 centipoise and about 50 centipoise, e.g., from about 5 centipoise to about 45 centipoise, or from about 7 centipoise to about 35 centipoise, at a temperature ranging from about 20° C. to about 150° C., e.g., from about 25° C. to about 75° C.

A photoinitiating system, e.g., a blend, in the inks is capable of initiating polymerization reactions upon irradiation, e.g., ultraviolet light irradiation.

The photoinitiating system can include, e.g., an aromatic ketone photoinitiator, an amine synergist, an alpha-cleavage type photoinitiator, and/or a photosensitizer. Each component is fully soluble in the monomers and/or diluents described above. Specific examples of the aromatic ketones include, e.g., 4-phenylbenzophenone, dimethyl benzophenone, trimethyl benzophenone (Esacure TZT), and methyl O-benzoyl benzoate.

An amine synergist can be utilized. For example, the amine synergist can be a tertiary amine. Specific examples of the amine synergists include, e.g., 2-(dimethylamino)-ethyl benzoate, ethyl 4-(dimethylamino) benzoate, and amine functional acrylate synergists, e.g., Sartomer CN384, CN373.

An alpha-cleavage type photoinitiator can be an aliphatic or aromatic ketone. Examples of the alpha-cleavage type photoinitiators include, e.g., 2,2-dimethoxy-2-phenyl acetophenone, 2,4,6-trimethylbenzoyl-diphenylphosphine oxide, and 2-methyl-1-[4-(methylthio)phenyl-2-morpholino propan-1-one (Irgacure 907).

A photosensitizer can be a substance that either increases the rate of a photoinitiated polymerization reaction or shifts the wavelength at which the polymerization reaction occurs. Examples of photosensitizers include, e.g., isopropylthioxanthone (ITX), diethylthioxanthone and 2-chlorothioxanthone.

The inks may contain an adjuvant such as a vehicle (e.g., a wax or resin), a stabilizer, an oil, a flexibilizer, or a plasticizer. The stabilizer can, e.g., inhibit oxidation of the ink. The oil, flexibilizer, and plasticizer can reduce the viscosity of the ink.

Examples of waxes include, e.g., stearic acid, succinic acid, beeswax, candelilla wax, carnauba wax, alkylene oxide adducts of alkyl alcohols, phosphate esters of alkyl alcohols, alpha alkyl omega hydroxy poly(oxyethylene), allyl nonanoate, allyl octanoate, allyl sorbate, allyl tiglate, bran wax, paraffin wax, microcrystalline wax, synthetic paraffin wax, petroleum wax, cocoa butter, diacetyl tartaric acid esters of mono and diglycerides, alpha butyl omega hydroxypoly (oxyethylene)poly(oxypropylene), calcium pantothenate, fatty acids, organic esters of fatty acids, amides of fatty acids (e.g., stearamide, stearyl stearamide, erucyl stearamide (e.g., Kemamide S-221 from Crompton-Knowles/Witco), calcium salts of fatty acids, mono & diesters of fatty acids, lanolin, polyhydric alcohol diesters, oleic acids, palmitic acid, d-pantothenamide, polyethylene glycol (400) dioleate, polyethylene glycol (MW 200-9,500), polyethylene (MW 200-21,000); oxidized polyethylene; polyglycerol esters of fatty acids, polyglyceryl phthalate ester of coconut oil fatty acids, shellac wax, hydroxylated soybean oil fatty acids, stearyl alcohol, and tallow and its derivatives.

Examples of resins include, e.g., acacia (gum arabic), gum ghatti, guar gum, locust (carob) bean gum, karaya gum (sterculia gum), gum tragacanth, chicle, highly stabilized rosin ester, tall oil, manila copais, corn gluten, coumarone-indene resins, crown gum, damar gum, dimethylstyrene, ethylene oxide polymers, ethylene oxide/propylene oxide copolymer, heptyl paraben, cellulose resins, e.g., methyl and hydroxypropyl; hydroxypropyl methylcellulose resins, isobutylene-isoprene copolymer, polyacrylamide, functionalized or modified polyacrylamide resin, polyisobutylene, polymaleic acid, polyvinyl acetate, polyvinyl alcohol, polyvinyl pyrrolidone, rosin, pentaerythritol ester, purified shellac, styrene terpolymers, styrene copolymers, terpene resins, turpentine gum, zanthan gum and zein.

Examples of stabilizers, oils, flexibilizers and plasticizers include, e.g., methylether hydroquinone (MEHQ), hydroquinone (HQ), butylated hydroxyanisole (BHA), butylated hydroxytoluene (BHT), propyl gallate, tert-butyl hydroquinone (TBHQ), ethylenediaminetetraacetic acid (EDTA), methyl paraben, propyl paraben, benzoic acid, glycerin, lecithin and modified lecithins, agar-agar, dextrin, diacetyl, enzyme modified fats, glucono delta-lactone, carrot oil, pectins, propylene glycol, peanut oil, sorbitol, brominated vegetable oil, polyoxyethylene 60 sorbitan monostearate, olestra, castor oil; 1,3-butylene glycol, coconut oil and its derivatives, corn oil, substituted benzoates, substituted butyrates, substituted citrates, substituted formats, substituted hexanoates, substituted isovalerates, substituted lactates, substituted propionates, substituted isobutyrates, substituted octanoates, substituted palmitates, substituted myristates, substituted oleates, substituted stearates, distearates and tristearates, substituted gluconates, substituted undecanoates, substituted succinates, substituted gallates, substituted phenylacetates, substituted cinnamates, substituted 2-methylbutyrates, substituted tiglates, paraffinic petroleum hydrocarbons, glycerin, mono- and diglycerides and their derivatives, polysorbates 20, 60, 65, 80, propylene glycol mono- and diesters of fats and fatty acids, epoxidized soybean oil and hydrogenated soybean oil.

Additional inks have been described by Woudenberg in Published U.S. Patent Application No. 2004/0132862 (now issued as U.S. Pat. No. 6,896,937).

In some embodiments, the inks used are hybrid-F UV curable jetting inks.

Referring back now to FIG. 1, in some embodiments, the docking station is in electrical communication with the print engine. For example, the docking station can include one or more valves operable on command from the print engine for controlling flow of the printing material in the material delivery module 12.

In general, during operation, the material delivery module prepares the material and maintains it during printing. The print engine, such as the SureFire 65™ print engine available from Dimatix (Spectra Printing Division), is coupled to the material delivery module. On request from the print engine, ink fills the on-board reservoirs of the print engine until full.

Figure 4:
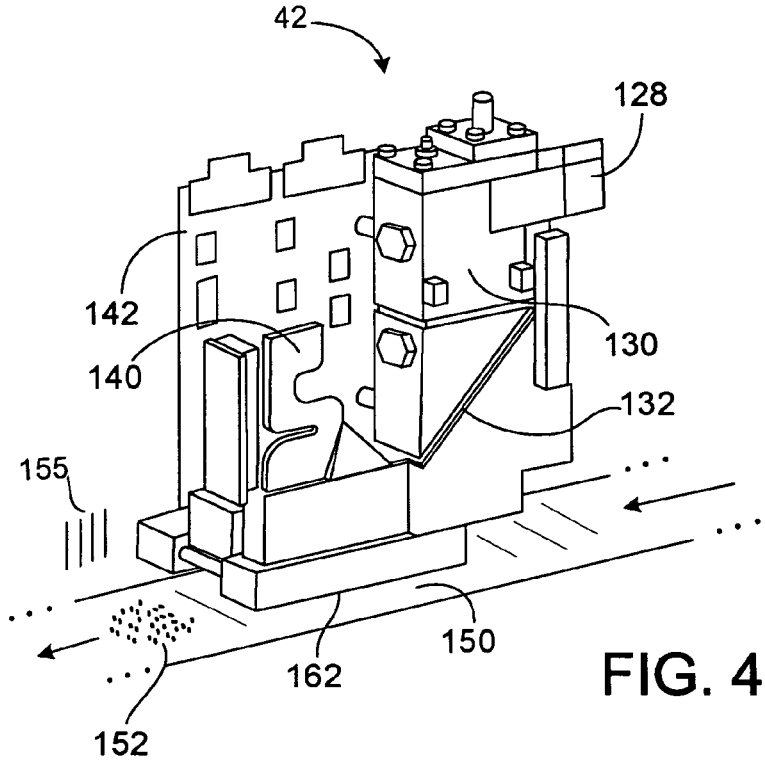
FIG. 4 is a perspective view of a print engine.

In the embodiment shown in FIG. 4, material is conveyed from the material delivery module 12 through interface 128 to reservoir 130 onboard print engine 42, where the temperature of the material is maintained at a suitable jetting temperature. The ink then travels along flow path 132 to printhead 140. Controller 142 controls the jetting of ink onto substrate 150, which is traveling below the printhead. Ink drop ejection is controlled by pressurizing ink with an actuator, which may be, e.g., a piezoelectric actuator, a thermal bubble jet generator, or an electrostatically deflected element. Typically, printhead 140 has an array of ink paths with corresponding nozzle openings and associated actuators, such that drop ejection from each nozzle opening can be independently controlled. U.S. Pat. No. 5,265,315 describes a printhead that has a semiconductor body and a piezoelectric actuator. Piezoelectric inkjet printheads are described in U.S. Pat. Nos. 4,825,227, 4,937,598, 5,659,346, 5,757,391, and in U.S. Patent Application No. 2004/0004649 (now issued as U.S. Pat. No. 7,052,117). Material, such as ink, on substrate 150, e.g., in the form of text or graphics 152, is cured with a radiation source 155, e.g., ultra-violet light or e-beam radiation. If UV radiation is used to cure the radiation-curable material, a wavelength of the light that cures the radiation-curable material is, e.g., preferably between about 200 nm and about 400 nm, e.g., a typical output from a medium pressure, metal-doped lamp, e.g., an iron-mercury lamp.

Figure 4A:
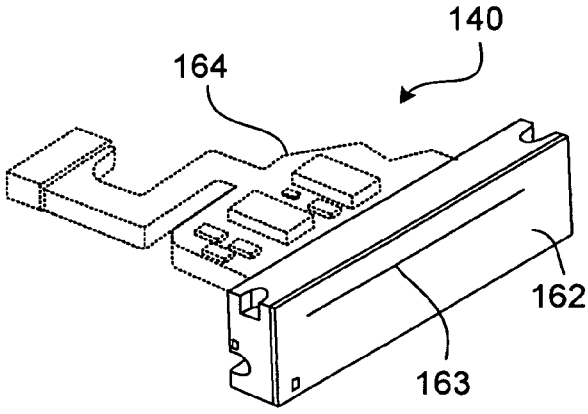
FIG. 4A is a front perspective view of the printhead shown in FIG. 4.
Figure 4B:
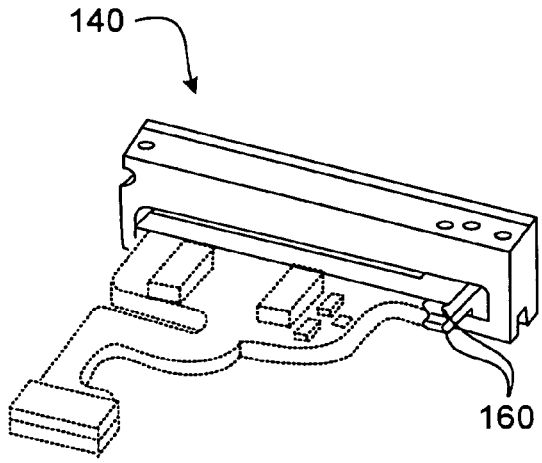
FIG. 4B is a back perspective view of the printhead shown in FIG. 4.
Figure 5:
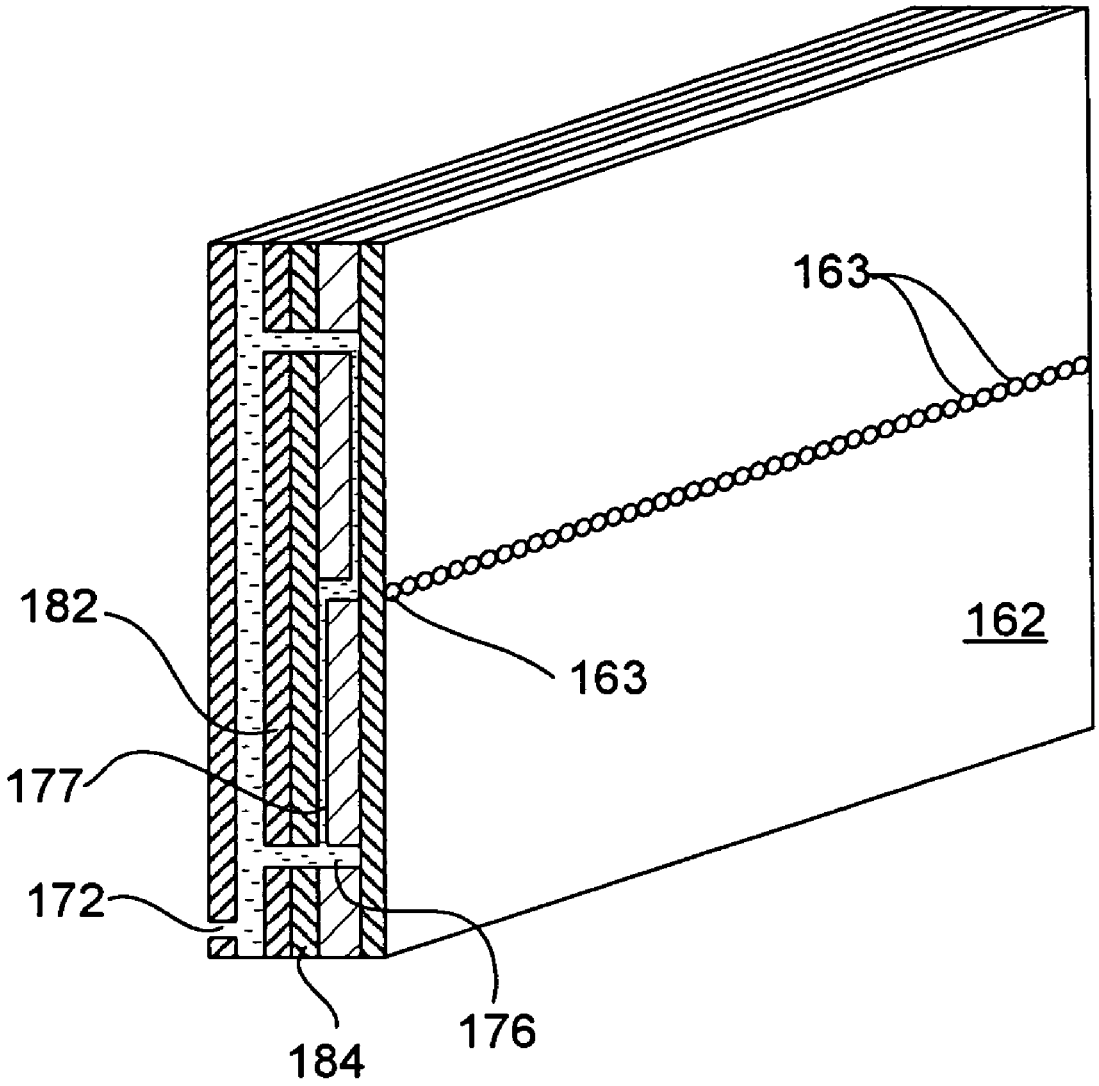
FIG. 5 is a perspective view of a portion of the printhead shown in FIG. 4, illustrating a pressure chamber and jetting apertures.

Referring now as well to FIGS. 4A, 4B and 5, a more detailed description of the operation of a piezoelectric print engine 42 is provided. Piezoelectric inkjet print engine 42 includes a printhead 140 that includes jetting modules 160 and an orifice plate 162 with an array of orifice openings 162. The orifice plate 162 is mounted on a manifold, attached to a collar. The inkjet printhead 140 is controlled by electrical signals conveyed by flexprint elements 164 that are in electrical communication with controller 142 of print engine 42.

Referring particularly to FIG. 5, in operation, material flows from a reservoir into a passage 172. The ink is then conveyed through passage 176 to a pressure chamber 177 from which it is ejected on demand through an orifice passageway and a corresponding orifice 163 in the orifice plate 162 in response to selective actuation of an adjacent portion 182 of a piezoelectric actuator plate 184.

Other Embodiments

While certain embodiments have been described, other embodiments are possible.

While inks have been discussed, the apparatuses and methods disclosed are suitable for other materials, e.g., clear overcoat materials. Flavors and fragrances can also be jetted or applied ("printed") onto substrates. Other embodiments are within the scope of the following claims.

What is claimed is:

1. A printing apparatus comprising:

a material delivery module comprising a reservoir for storing a printing material, a docking station, and a conduit connecting the reservoir and the docking station, the conduit having a conduit wall defining an inner conduit space and including a material line in the inner conduit space for carrying the printing material from the reservoir to the docking station, wherein the conduit is configured to carry a heated liquid, being heated from a liquid heater, flowing in the inner conduit space to contact the material line; and a print head optionally connected to the docking station for ejecting drops of the printing material.

2. The printing apparatus of claim 1, wherein the material delivery module further comprises the liquid heater in communication with the inner conduit space.

3. The printing apparatus of claim 2, wherein the liquid heater includes the heated liquid replenishing port for replenishing spent and/or evaporated liquid.

4. The printing apparatus of claim 2, wherein the conduit also includes the heated liquid flowing in the inner conduit space, the flowing liquid entering the inner conduit space from the heater through an entry port, and then exiting the inner conduit space through an exit port in fluid communication with the heater.

5. The printing apparatus of claim 1, wherein the conduit also includes a liquid flowing in the inner conduit space, the flowing liquid and/or any material being carried in the material line being held at a temperature that does not vary with time by more than about 3.5° C. above a set point or about 6.0° C. below the set point after thermal equilibrium is established.

6. The printing apparatus of claim 1, wherein the conduit also includes a liquid flowing in the inner conduit space at a temperature above about 25° C.

7. The printing apparatus of claim 6, wherein the heated liquid has a specific heat capacity at 25° C. ($C_{p25°\ C.}$) of greater than about 2.0 J/gK.

8. The printing apparatus of claim 6, wherein the heated liquid has a boiling point of greater than about 80° C.

9. The printing apparatus of claim 6, wherein the heated liquid is a mixture of water and ethylene glycol.

10. The printing apparatus of claim 1, wherein the docking station is in electrical communication with the print head.

11. The printing apparatus of claim 10, wherein the docking station includes a valve operable on command from the print head for controlling flow of the printing material.

12. The printing apparatus of claim 1, wherein the reservoir is connected to the conduit by an interface that includes a liquid flow pathway for delivering the heated liquid to the inner conduit space of the conduit.

13. The printing apparatus of claim 1, wherein the conduit is connected to the docking station by an interface that includes a liquid return pathway for transferring the heated liquid exiting the conduit into a liquid return line in the inner conduit space.

14. The printing apparatus of claim 1, wherein the reservoir includes a pump for conveying the printing material through the material line in the conduit.

15. The printing apparatus of claim 1, wherein the reservoir includes a mixing device for homogenizing the printing material.

16. The printing apparatus of claim 1, wherein the inner conduit space includes multiple material lines.

17. The printing apparatus of claim 1, wherein the inner conduit space includes the liquid return line in communication with a heater.

18. The printing apparatus of claim 1, wherein the material delivery module includes an ink in a component thereof.

19. The printing apparatus of claim 18, wherein the ink includes a radiation curable material.

20. An apparatus for handling a printing material comprising a conduit having a conduit wall defining an inner conduit space and including a material line for carrying the printing material in the inner conduit space, wherein the inner conduit space is configured to carry a heated liquid, being heated from a liquid heater, to contact the material line.

21. The apparatus of claim 20, wherein the conduit includes a liquid flowing in the inner conduit space, the flowing liquid and/or any material being carried in the material line being held at a temperature that does not vary with time by more than about 2.0° C. above a set point or about 5.0° C. below the set point after thermal equilibrium is established.

22. The apparatus of claim 21, wherein the liquid has a specific heat capacity at 25° C. ($C_{p25°\ C.}$) of greater than about 2.0 J/gK.

23. A method of handling a printing material, the method comprising the steps of:

providing a printing material; and conveying the printing material through an apparatus comprising a conduit having a conduit wall defining an inner conduit space and including a material line containing the printing material, wherein the inner conduit space is configured to carry a heated liquid, being heated from a liquid heater, to contact the material line.

24. A method of printing on a substrate, the method comprising the steps of:

providing a printing material;

conveying the printing material through an apparatus comprising a conduit having a conduit wall defining an inner conduit space and including a material line in the inner conduit space carrying the printing material, wherein the conduit also includes a heated liquid, being heated from a liquid heater, flowing in the inner conduit space to contact the material line, and a pressure chamber communicating with the material line and an aperture; and pressurizing the pressure chamber to eject drops of the printing material out of the aperture.

25. The method of claim 24, wherein the pressure chamber forms part of a piezoelectric printhead.

26. The method of claim 24, wherein the printing material comprises an ink.

27. The method of claim 26, wherein the ink comprises a radiation curable material.

* * * * *

UNITED STATES PATENT AND TRADEMARK OFFICE

CERTIFICATE OF CORRECTION

PATENT NO. : 7,748,832 B2
APPLICATION NO. : 11/647835
DATED : July 6, 2010
INVENTOR(S) : Scott G. Page, James M. Cheever and L. Edward Drew, II It is certified that error appears in the above-identified patent and that said Letters Patent is hereby corrected as shown below:

Column 10, line 63, (line 2 of Claim 3) delete "the heated liquid" and insert -- a liquid --, therefor.

Column 11, line 11, (line 2 of Claim 6) after "includes" delete "a" and insert -- the heated --, therefor.

Signed and Sealed this

Fourteenth Day of December, 2010

David J. Kappos

David J. Kappos
*Director of the United States Patent and Trademark Office*